US008132672B2

(12) United States Patent
Ganti

(10) Patent No.: US 8,132,672 B2
(45) Date of Patent: Mar. 13, 2012

(54) PILL POUCH POCKET PACKET FOLDER, A FLEXIBLE PILL CARRIER

(76) Inventor: Sastry K. Ganti, Buffalo Grove, IL (US)

( * ) Notice: Subject to any disclaimer, the term of this patent is extended or adjusted under 35 U.S.C. 154(b) by 0 days.

(21) Appl. No.: 12/924,367

(22) Filed: Sep. 27, 2010

(65) Prior Publication Data

US 2011/0186470 A1 Aug. 4, 2011

Related U.S. Application Data

(60) Provisional application No. 61/337,327, filed on Feb. 3, 2010.

(51) Int. Cl.
*B65D 85/42* (2006.01)
*B65D 30/22* (2006.01)
*B65D 33/24* (2006.01)

(52) U.S. Cl. ..... 206/539; 383/39; 383/86

(58) Field of Classification Search ..... 206/538, 206/539; 383/38, 39, 86, 84, 85; 150/116, 150/118, 138

See application file for complete search history.

(56) References Cited

U.S. PATENT DOCUMENTS

| | | | | | |
|---|---|---|---|---|---|
| 445,216 | A | * | 1/1891 | Andrews | 383/86 |
| 1,368,579 | A | * | 2/1921 | Schochet | 150/118 |
| 1,564,967 | A | * | 12/1925 | Kulick | 150/116 |
| 2,438,655 | A | * | 3/1948 | Becker | 150/138 |
| 2,754,867 | A | * | 7/1956 | Langer | 383/39 |
| 3,187,903 | A | * | 6/1965 | Oltz | 383/38 |
| 3,432,951 | A | * | 3/1969 | Cherrin | 206/539 |
| 3,557,853 | A | * | 1/1971 | Jones | 383/86 |
| 4,262,802 | A | | 4/1981 | Laauwe | |
| 4,378,885 | A | | 4/1983 | Leopoldi et al. | |
| 4,749,085 | A | | 6/1988 | Denny | |
| 4,907,634 | A | * | 3/1990 | Yoo | 150/138 |
| 5,495,971 | A | * | 3/1996 | Holliday | 383/39 |
| 5,779,033 | A | * | 7/1998 | Roegner | 383/39 |
| 5,915,558 | A | | 6/1999 | Girvetz | |
| 6,041,932 | A | * | 3/2000 | Holmberg | 383/39 |
| 7,637,449 | B1 | | 12/2009 | Leyshon et al. | |

* cited by examiner

*Primary Examiner* — Bryon Gehman

(57) ABSTRACT

A flexible, compact, and securely closed pill pouch pocket packet folder designed for secure handling, has multiple pockets, containing securely stored pouches for easy and orderly storing and retrieving of pills or similar small items, as when needed, for home or travel.

2 Claims, 11 Drawing Sheets

Figure 1:
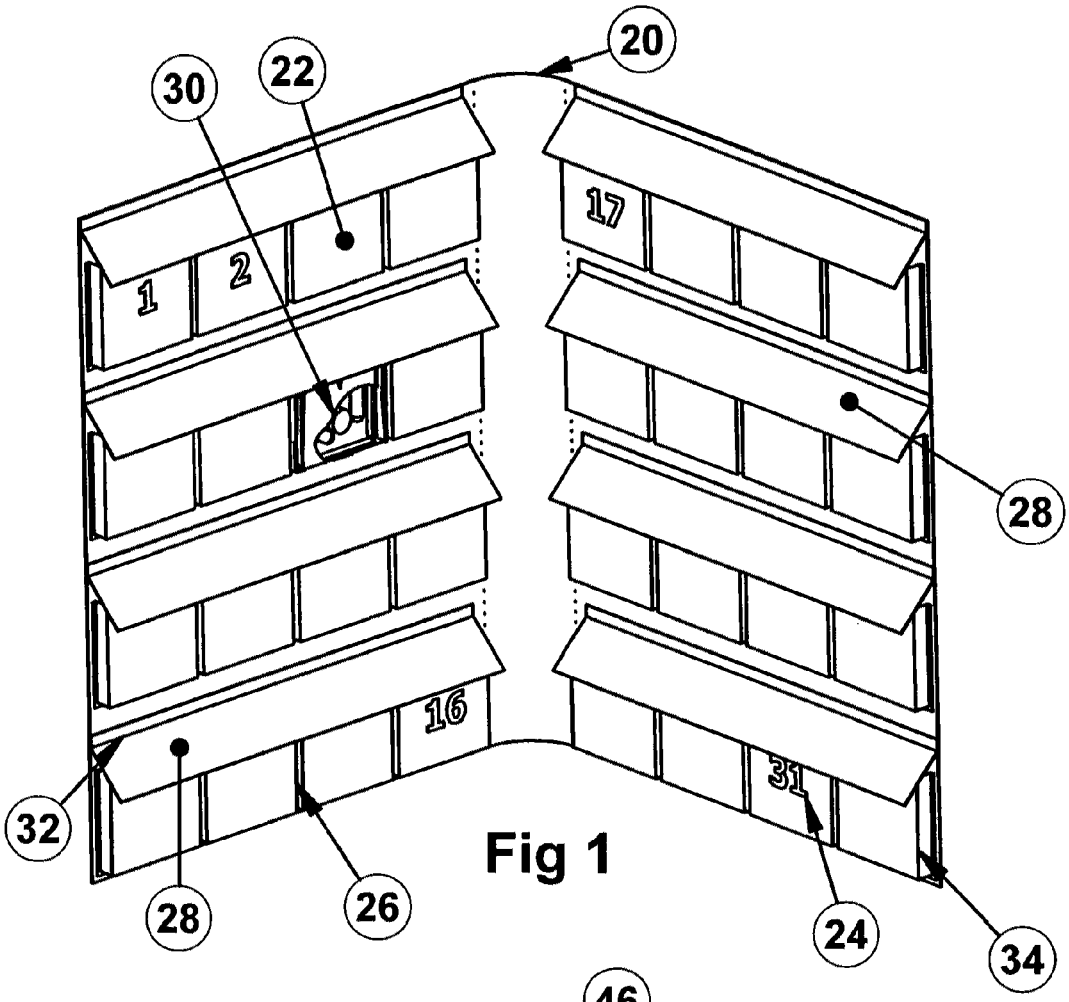

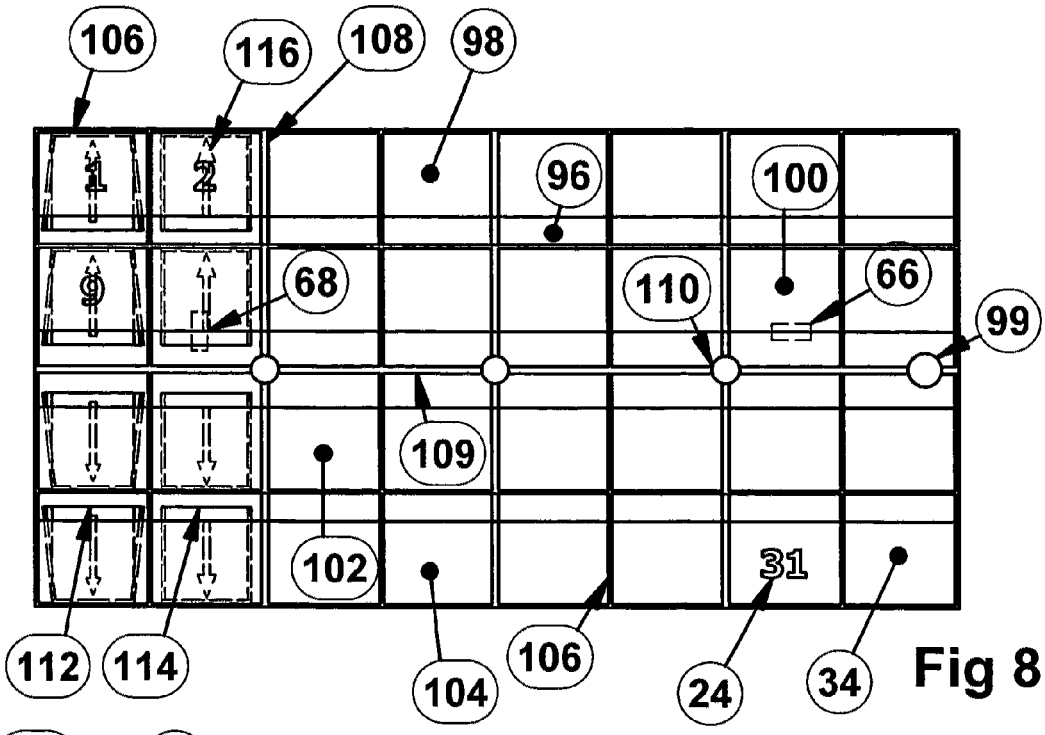
Fig 8
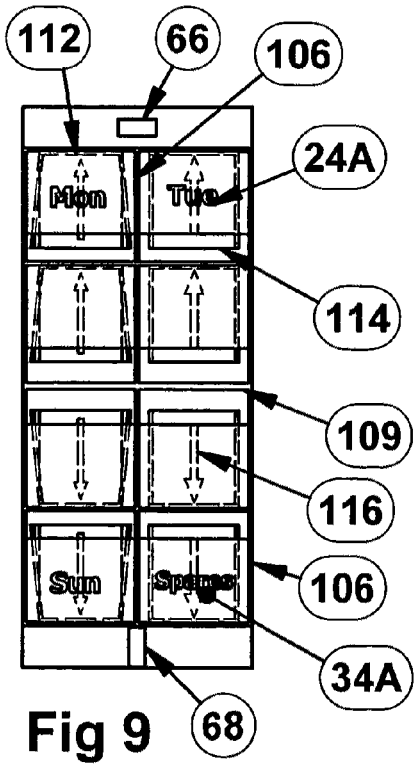
Fig 9
Fig 10
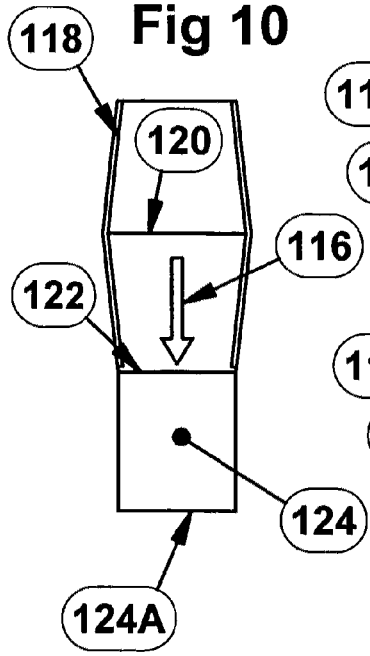
Fig 11
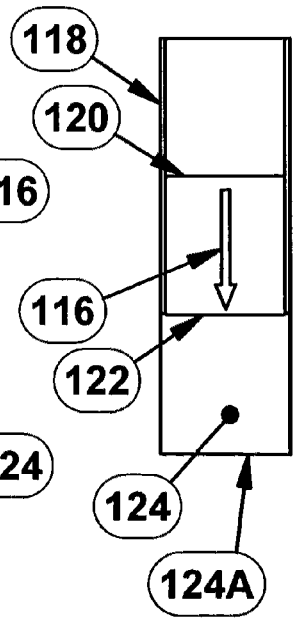

PILL POUCH POCKET PACKET FOLDER, A FLEXIBLE PILL CARRIER

CROSS-REFERENCE TO RELATED APPLICATION

This application claims the benefit of provisional patent application, U.S. 61/337,327, filed Feb. 3, 2010.

FEDERALLY SPONSORED RESEARCH

Not applicable

SEQUENCE LISTING OR PROGRAM

Not applicable

BACKGROUND OF THE INVENTION

1. Field of Invention

This invention relates to a hand held, flexible, lightweight, folded packet made out one or more of sheets whose surfaces have several permanent pockets, formed by sewing, sealing, gluing, etc., with each capable of holding snugly, securely, one or more flexible pouches to contain small items such as pills. The pill-pouch-pocket-packet folder can be folded, and then securely closed with buttons, zippers, 'hook and loop' devices, etc., and, as needed opened to easily remove any pouch to dispense its contents if it has any, or if the pouch is empty, fill it with small items such as pills. Pill-pouch—pocket-packet folders will popularly contain 8 pockets to represent a week's supply of pouches plus spare pouches in the $8^{th}$ pocket, or 32 pockets for a month's supply of pouches with one or two spare pockets with pouches.

2. Prior Art

To carry, store, dispense, or display small items such as pills, assortment of sewing items, fishermen gear, nuts, bolts, washers, etc. prior art has generally focused on rigid containers such as compartmentalized boxes, or individualized bottles, etc., made of plastic.

Such containers, especially for pills, have several disadvantages:

(1) compartmentalized plastic pill boxes with lids, being rigid, occupy undue amount of space;

(2) the lids of plastic pill boxes do not have real hinges, and hence, due to fatigue are prone to breakage, thus voiding the entire container;

(3) the lids of pill box compartments are 'snap shut'; such design makes the lid difficult to operate;

(4) the opening motion of all lids is not uniform in effort or operation; the entire pill box with its contents shakes and vibrates due to the opening of a single lid, jeopardizing the stability of contents of any other open compartments;

(5) filling or emptying the compartments of contents is cumbersome; the miniaturized compartments are not convenient for one's fingers, to separate, grasp and remove individual items in a given compartment;

(6) filling individual compartments correctly poses difficulties, especially for medicine pill boxes; the palm and fingers tend to obscure the dropping trajectory of pills into designated compartments, and often pills fall into the wrong compartment avoiding detection;

(7) pill boxes can only be stored in a horizontal orientation, and hence tend to be placed inside drawers or on horizontal surfaces of furniture or on quasi-horizontal surfaces such as a stack of paper material or clothes;

(8) storing inside drawers taxes the memory of the user for its location and the drawers may have to be opened to extra distance to remove or replace pill boxes having compartments in both X and Y directions;

(9) all the stated locations are generally within the reach of unauthorized persons such as children, or pets;

(10) the snap action of the pillbox lid is taxing on senior people and people with arthritic conditions, especially when the grab hook of lids wears off or breaks;

(11) rigid compartmentalized pill boxes have limitations as to their dimensions in relation to the number of compartments and portability; it is impractical to make a portable pill box to contain 31 days supply with separate morning, mid-day and late day medication compartments;

(12) each pill compartment has no flexibility to adapt in size and shape to the amount of medication it contains;

(13) pill boxes are cumbersome at best for travel, vacations, outdoor excursions, etc.

(14) pill box contents are noisy;

(15) plastic materials of the pill boxes are not environmentally friendly;

(16) If accidentally, a pill box falls to the floor, there is danger of one or more of the weaker lids popping open and its compartment's contents spilling;

(17) pill boxes are not ideal to dispense or carry liquid or powdered medication doses;

(18) design improvements and modifications require new, expensive tooling.

3. Objects and Advantages

Accordingly, the objects and advantages of invention presented in this patent application, to overcome the disadvantages of present rigid box system, are itemized below:

(a) in a pill-pouch-pocket-packet folder, the folder is flexible into multiple folds; the pouches that contain the pills are also flexible;

(b) the entire product adapts to the contents to conserve space and shape;

(c) the flap of a pouch (inside which is the space for the pills) that covers the opening of the pouch, is long and it is securely tucked into a pocket; with the tip of the flap jutting out of the pocket; the covered opening of the pouch is also securely tucked into the pocket toward its bottom; the flap can only be flipped open or closed when the pouch is completely outside the pocket,—say securely in one's hand; the pouch is inserted or pulled out by pinching the flap's tip shut against the closed bottom of the pouch which is directly opposite to the flap's tip;

In other words, the entire process of filling or emptying a pouch, closing or opening its flap, inserting or removing the pouch into or from a pocket, is effortless and secure in relation to the contents inside the pouch;

(d) multiple pouches can be inserted into the same pocket;

(e) should a pouch tear after repeated use,—it being very inexpensive it may be discarded, and one of the spares located in the folder may be permanently substituted in its place;

(f) since each pouch is individually filled only when it is out from its pocket, the filling operation is easy, secure and accurate; dispensing operation is also easy and secure, since the contents can be handled from each pouch singly or en masse;

(g) people with arthritic disabilities, and such, will find the soft pouches easy to fill or dispense or, insert or remove from pockets;

(h) a pill-pouch-pocket-packet folder can be securely placed in any orientation literally anywhere; If provided so with hang holes or a handle, it can be safely hung on a closet hook or hanger, away from children and pets;

(i) a pill-pouch-pocket-packet folder with adequate number of folds can easily be designed to contain two months supply, or more, of pouches, and still take up only a reasonable amount of space;

(j) the pill-pouch-pocket-packet folder, its pockets, and the pouches, can all be made of soft flexible materials such as paper, cloth, vinyl, leather, non-woven and flash spun fabrics, etc.;

(k) when made of leather, fabric and paper, all the materials are environmentally friendly;

(l) It will be possible to store liquid or powdered doses of prescription that are sealed in 'condiment packet' type leak-proof containers;

(m) should the pill-pouch-pocket-packet folder drop on to the ground, its contents will be cushioned and remain secure with no spillage or breakage;

(n) pill-pouch-pocket-packet folder contents will not rattle to make noise;

(o) pill-pouch-pocket-packet folder will be an excellent companion for travel, vacations, outdoor excursions, etc.; designed as a wrist band, it will be excellent for strenuous activities such as running, biking, etc.

(p) design changes are easy to accommodate;

(q) any minor damage or tear to a pill-pouch-pocket-packet folder can usually be repaired by the user, at least on temporary basis.

SUMMARY

In accordance with presented invention, the flexible, foldable product consists of a pill-pouch-pocket-packet folder with multiple surfaces containing permanent pockets, with the pockets providing to securely store in an organized manner removable pouches that can contain small items such as pills.

DRAWINGS, FIGURES

FIG. 1 Pill-pouch-pocket-packet, representative notebook, 32 pocket folder

Figure 2:
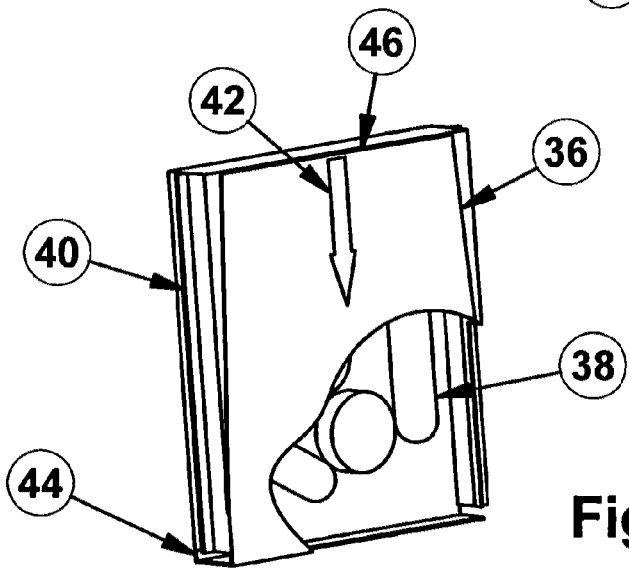

FIG. 2 Pill pouch, representative cut-away perspective view showing pills

Figure 3:
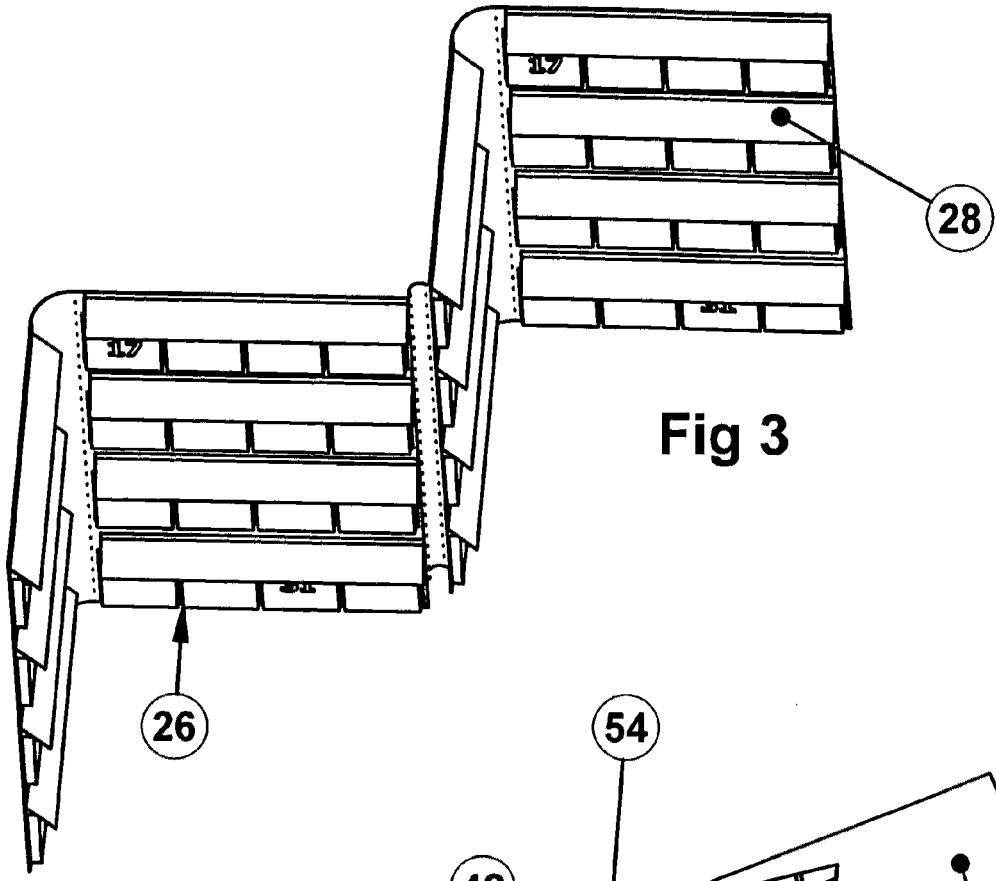

FIG. 3 Pill-pouch-pocket-packet, four leaf 64 pocket folder, notebook style

Figure 4:
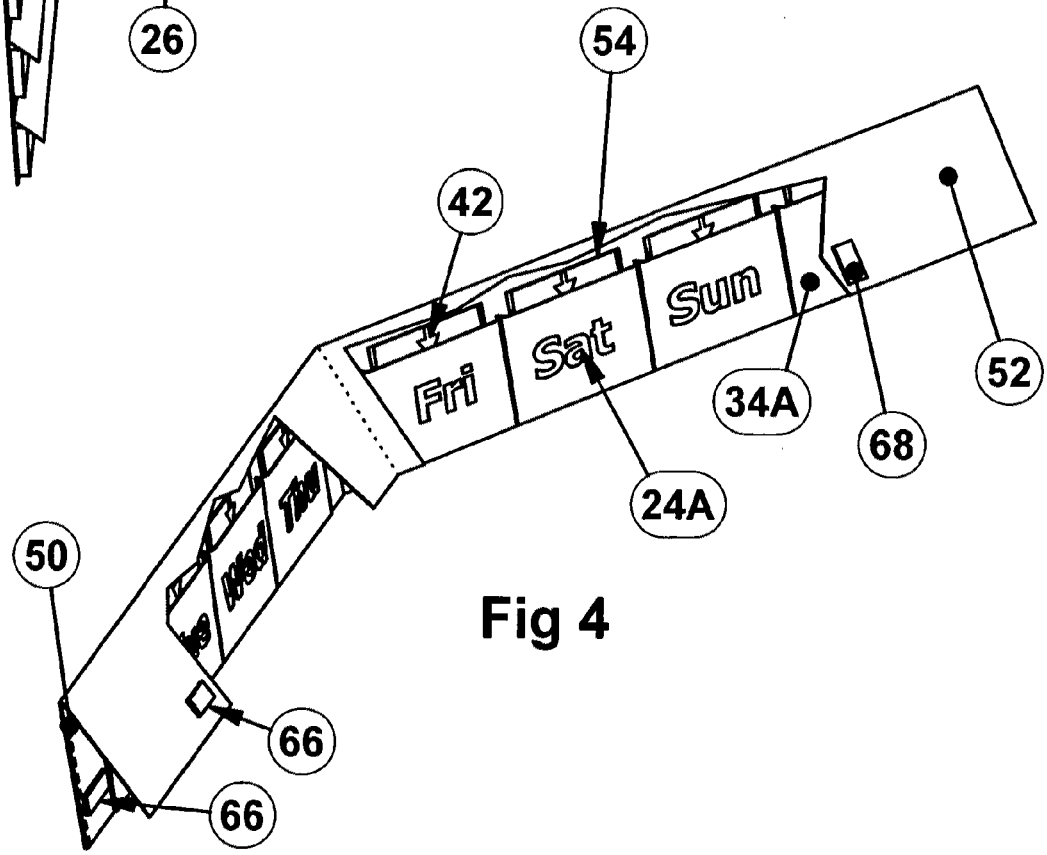
Figure 5:
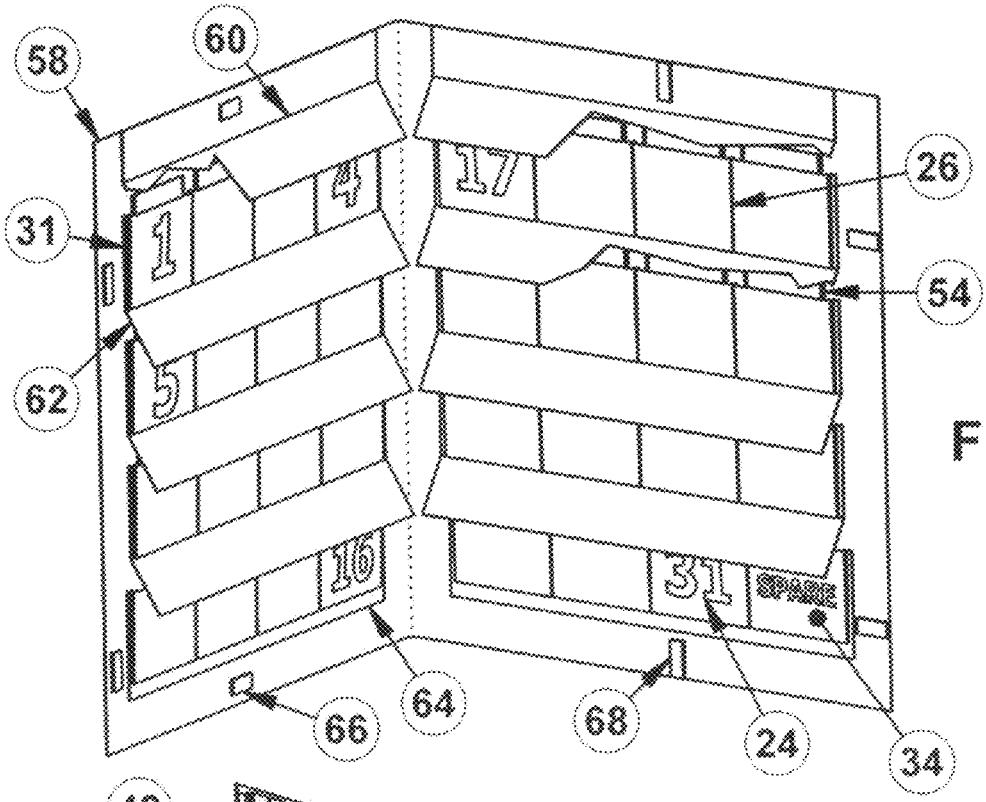
Figure 6:
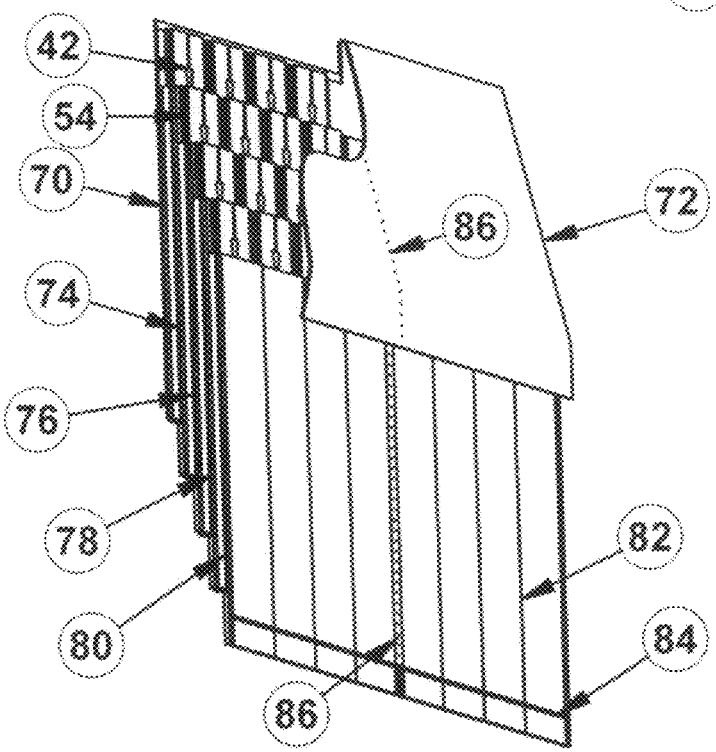
Figure 7:
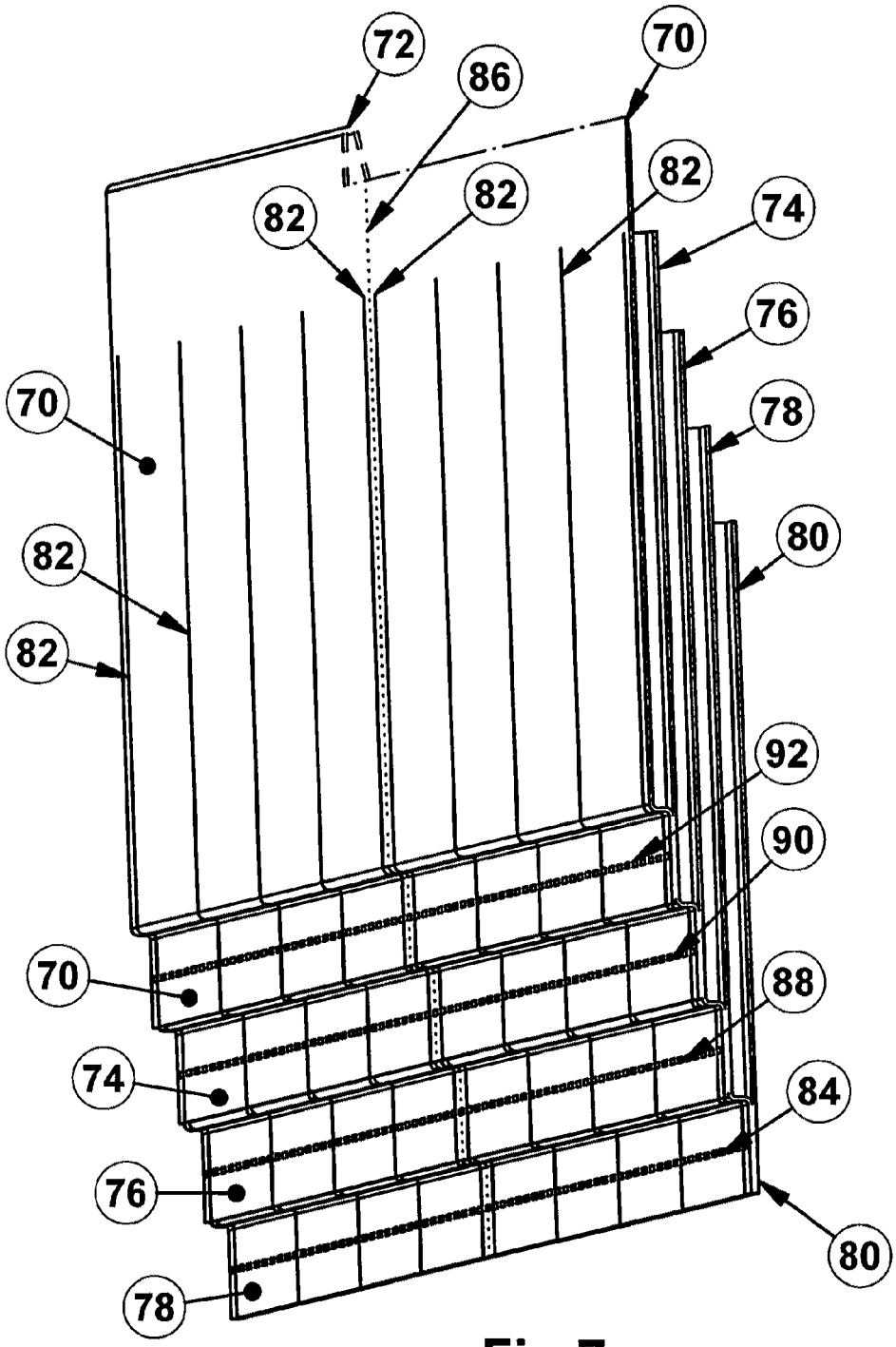
Figure 12:
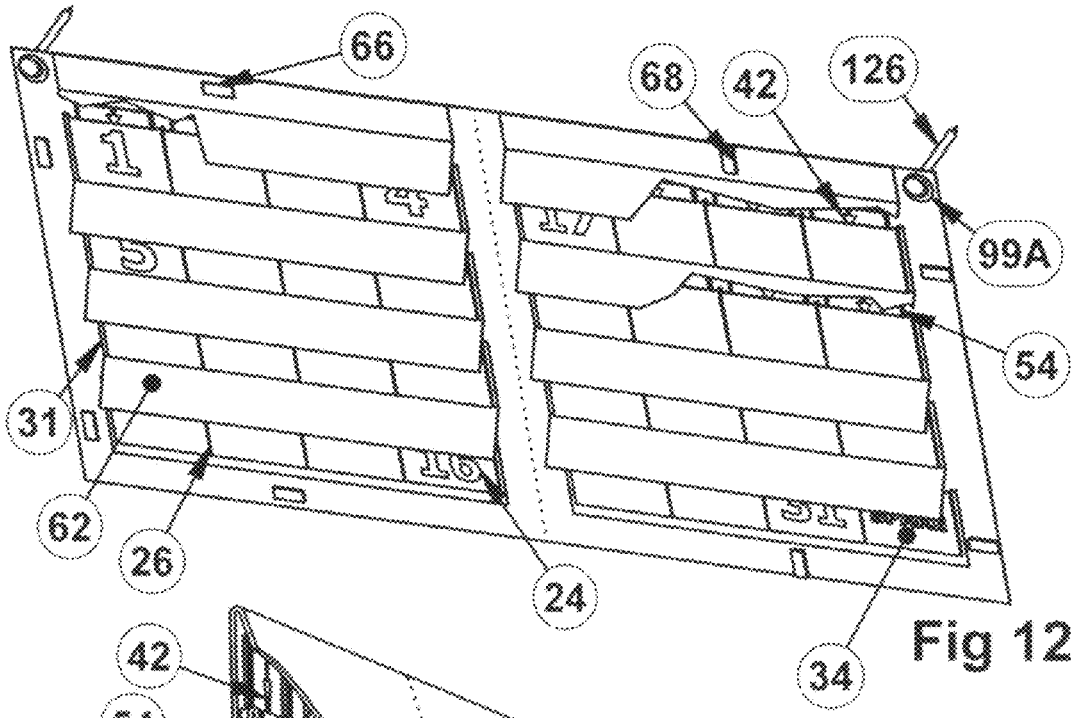
Figure 13:
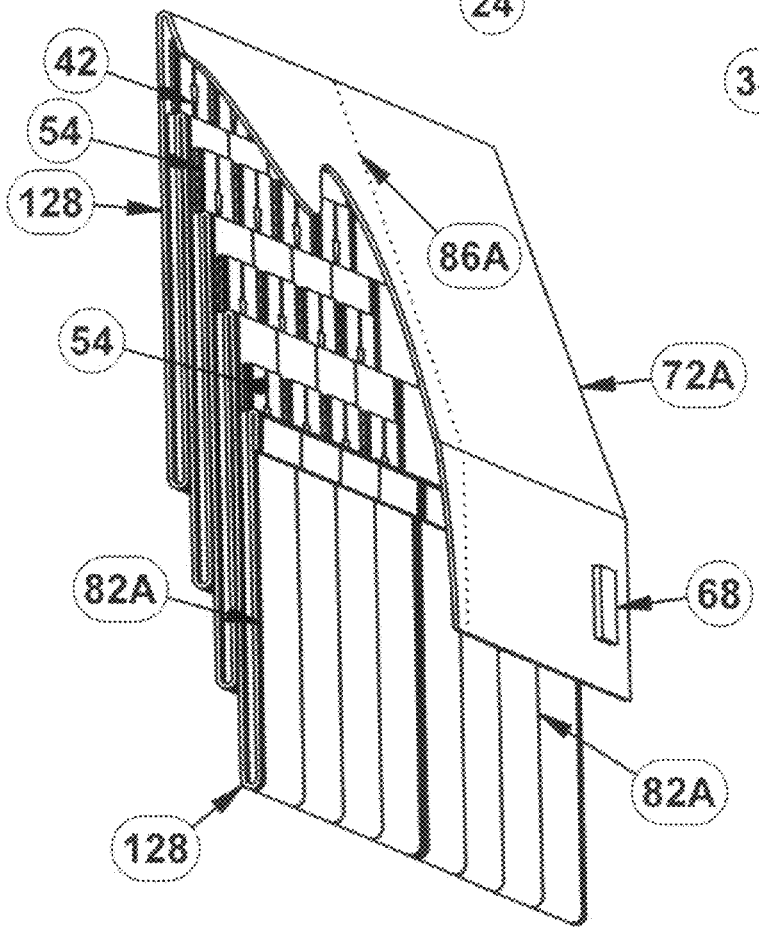
Figure 14:
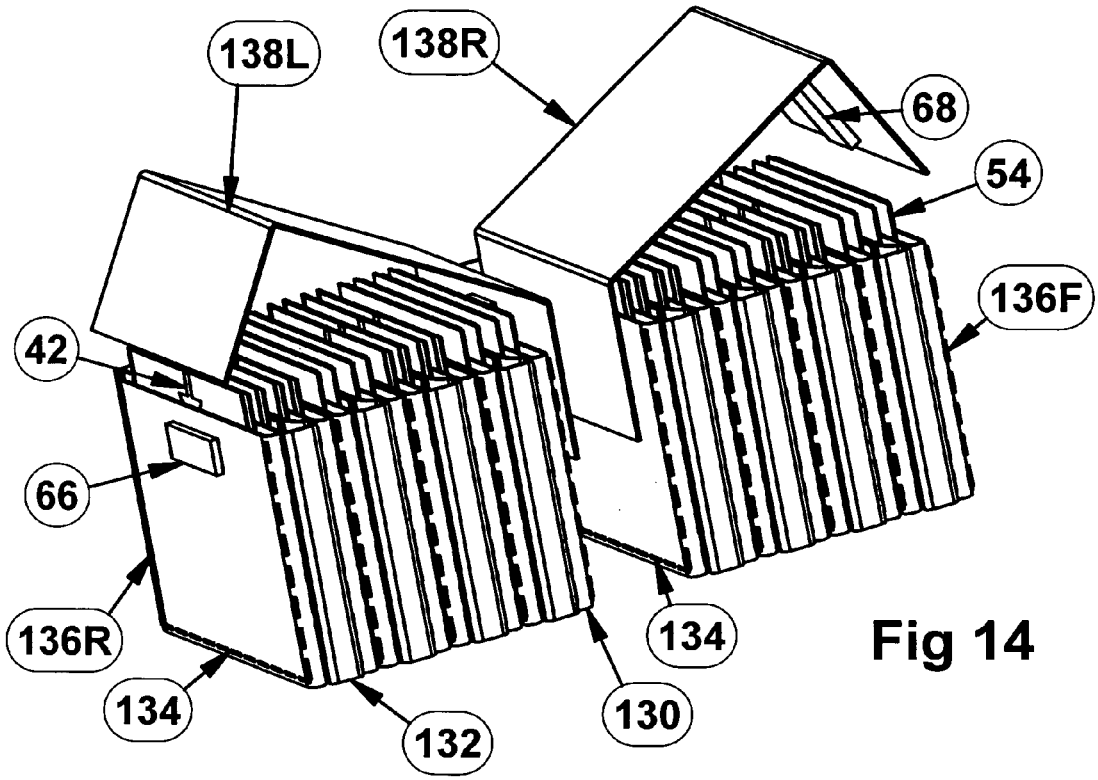
Figure 15:
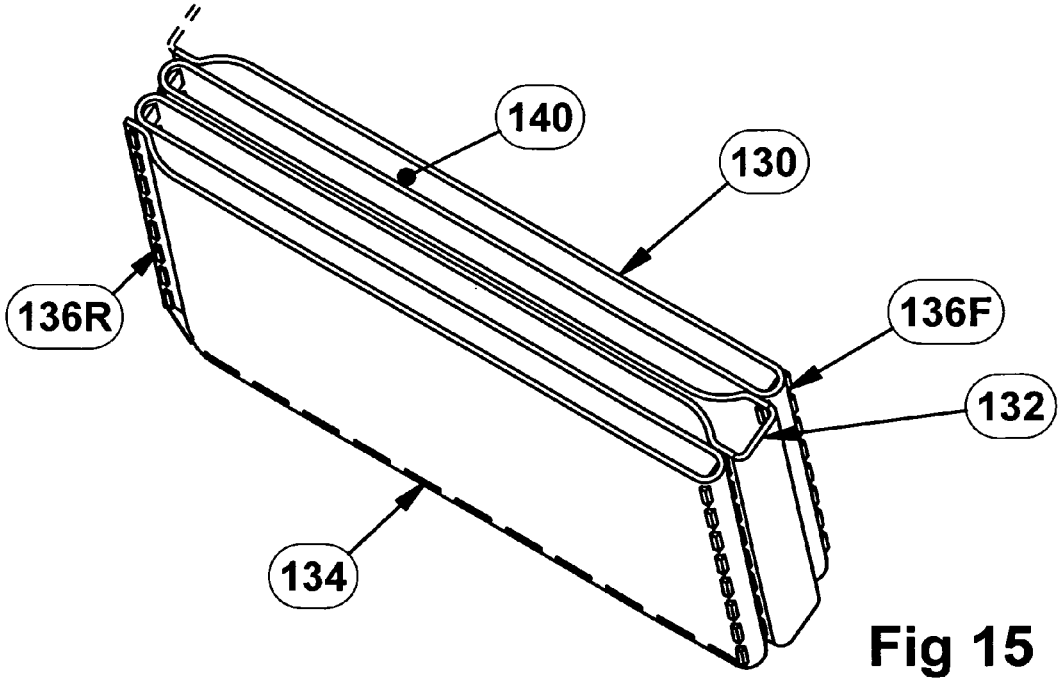
Figures 16, 17:
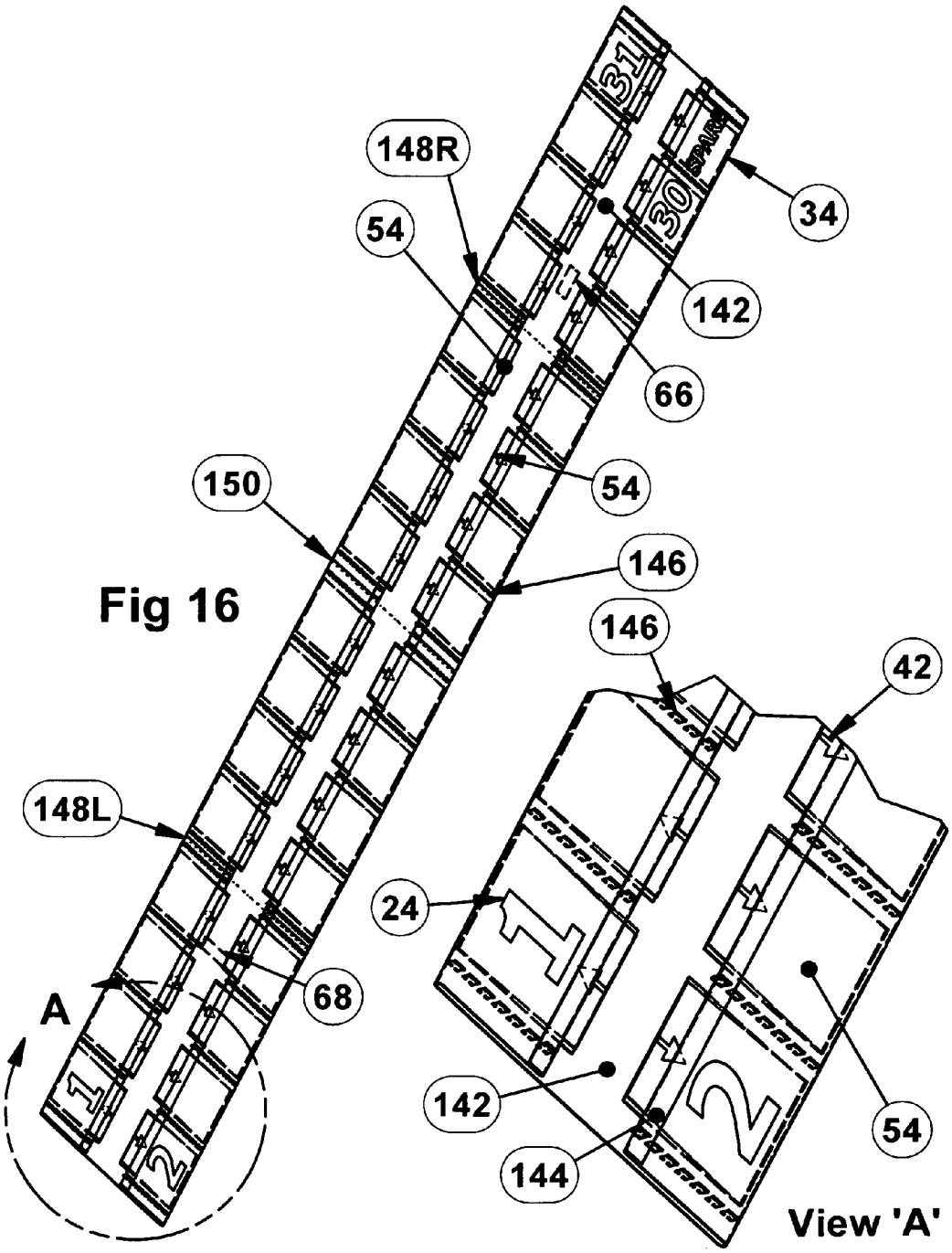

FIG. 4 Pill-pouch-pocket-packet. 8 pocket folder,—of single rectangular sheet FIG. 5 Pill-pouch-pocket-packet, 32 pocket folder with hook-and-loop fasteners FIG. 6 Pill-pouch-pocket-packet, stadium seating style folder, front perspective FIG. 7 Pill-pouch-pocket-packet, stadium seating style folder, rear perspective FIG. 8 Pill-pouch-pocket-packet, 32 pockets, 2 rows facing 2 rows FIG. 9 Pill-pouch-pocket-packet, 8 pockets, 2 rows facing 2 rows FIG. 10 Pill pouch, flat development of trapezium shaped style FIG. 11 Pill pouch, flat development of rectangle shaped style FIG. 12 Pill-pouch-pocket-packet, folder with wall hanging holes FIG. 13 Pill-pouch-pocket-packet, stadium seating style, single convoluted sheet FIG. 14 Pill-pouch-pocket-packet, single serpentine style serial row of pockets FIG. 15 Four representative pockets from FIG. 14 type pill-pouch-pocket-packet FIG. 16 Pill-pouch-pocket-packet, single sheet folder, 2 rows of opposed pockets FIG. 17 Pill-pouch-pocket-packet, enlarged view of partial region of FIG. 15

Figure 18:
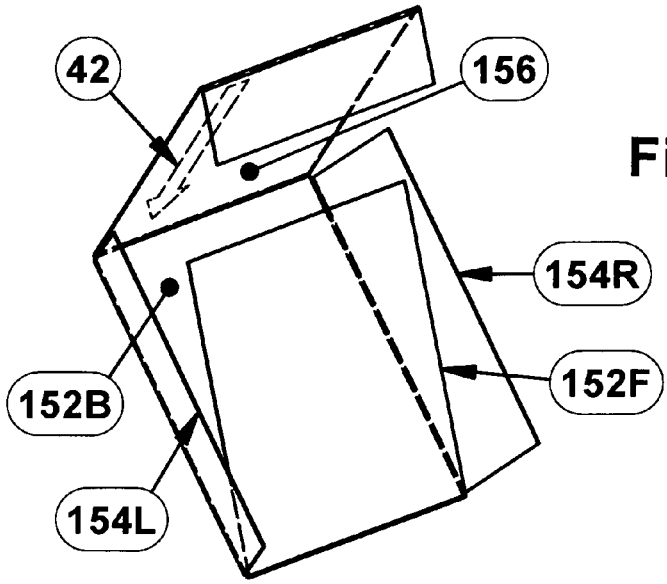

FIG. 18 Non glued/non sealed/non stitched (that is—open, folded) pouch

Figure 19:
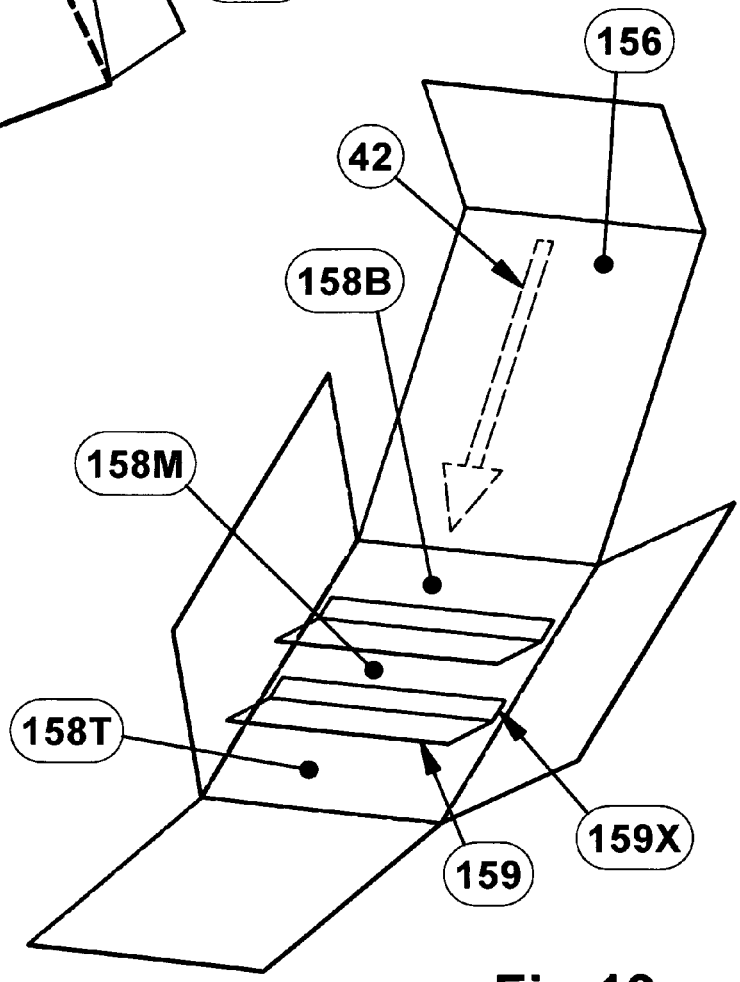

FIG. 19 Open folded pouch with partitioning flaps to divide pill doses

Figure 20:
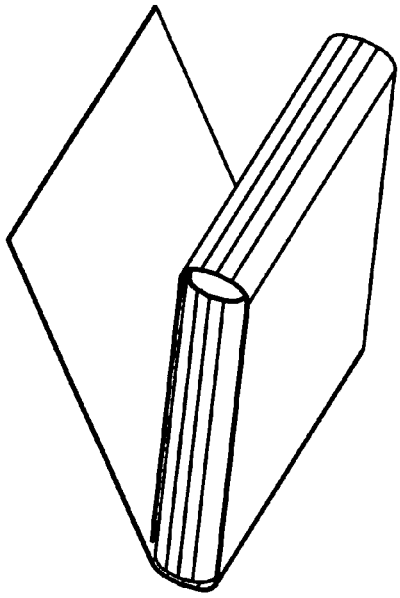

FIG. 20 Two piece pouch

Figure 21:
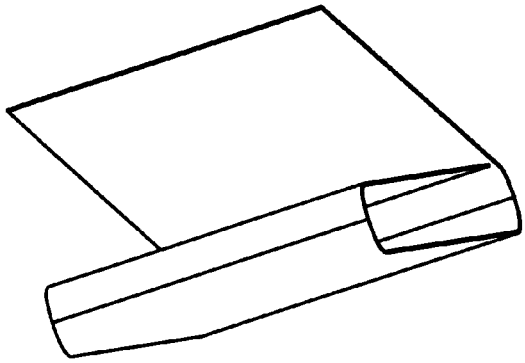

FIG. 21 Outer open folded sheet piece of pouch of FIG. 17

Figure 22:
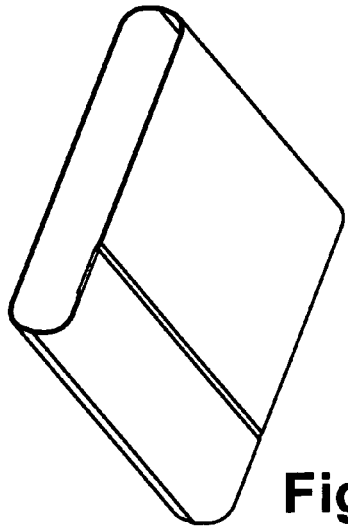

FIG. 22 Inner sealed/glued/stitched ring sheet piece of pouch of FIG. 17

Figure 23:
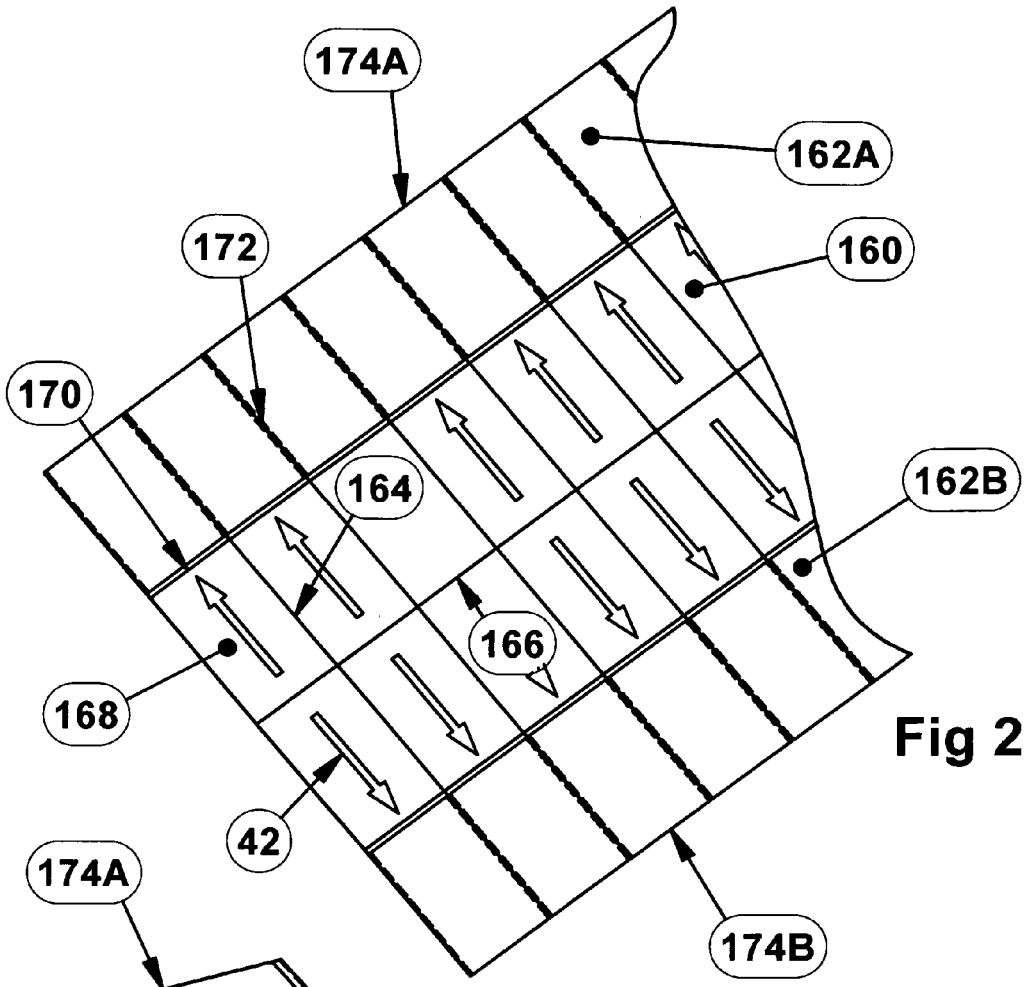

FIG. 23 Mass production idea of pouches from double folded continuous sheet

Figure 24:
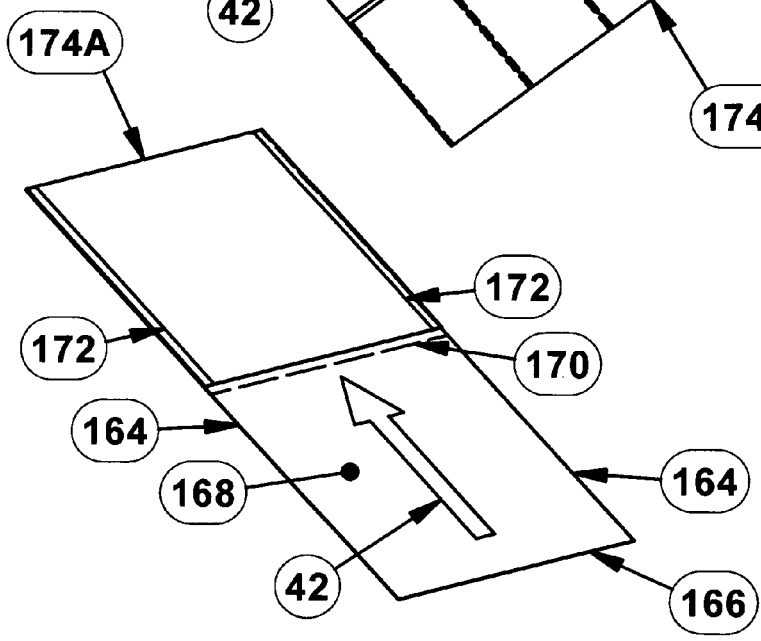

FIG. 24 Single pouch cut out from sheet as in FIG. 18

REFERENCE NUMERALS

20 Folded main sheet of basic note book style folder

22 Representative pocket for a pouch

24 Representative pocket numbering (day of month), 1-31 for 32 pocket folder

24A Representative pocket naming (day of week), Mon, Tue . . . for 8 pocket folder

26 Representative stitch/seal/glue line between adjacent pockets

28 Individual flap, covering a row of 4 pockets

30 Cut-out in a pocket to reveal a pouch with cut-out, showing pills inside

31 Pocket sheet at 32 pocket folder, integral with flap sheet (see 62 below)

32 Stitch/seal/glue line for a representative flap with main sheet

34 $32^{nd}$ pocket, representative, to contain spare pouches

34A $8^{th}$ pocket, of a 8 pocket folder, representative for spare pouches

36 Representative (long) flap covering the opening on a pouch

38 Representative pills inside a pouch revealed through cut-out

40 Representative sac portion of a pouch

42 Representative arrow, insertion direction of a pouch into a pocket

44 Opening in the sac of a pouch, inserted toward the bottom end of a pocket

46 Finger pinch region of the closed pouch, tip of the flap, during handling

50 Single rectangular sheet with two folds to form 8 pockets and flap

52 Integral flap of sheet (see 50 above) covering 8 pockets

54 Representative pouch inserted in a pocket

58 Main sheet of a 32 pocket folder with integral flap (see 60 below)

60 Flap sheet Integral with main (see 58 above) sheet, covering pockets

62 Flap sheet integral with pocket sheet (see 31 above)

64 Bottom sheet forming pockets (having no integral flap)

66 Rectangular 'hook-and-loop' fastener half, installed horizontally

68 Rectangular 'hook-and-loop' fastener half, installed vertically

70 Main back-most sheet 'A' of a 'stadium seating' style folder

72 Flap integral with main back sheet (see 70 above) covering all pockets
72A Flap integral with main back sheet (see 128 below) covering all pockets
74 Sheet 'B' in front of sheet 'A' (see 70 above)
76 Sheet 'C' in front of sheet 'B' (see 74 above)
78 Sheet 'D' in front of sheet 'C' (see 76 above)
80 Sheet 'E' in front of sheet 'D' (see 78 above), front-most sheet
82 Representative vertical stitch/seal/glue line separating pockets
82A Representative vertical stitch/seal/glue line separating pockets
84 Horizontal Stitch/seal/glue line between Sheets 'E' (80) and 'D' (78)
86 Center fold line (vertical) for folder (FIGS. 6 and 7)
86A Center fold line (vertical) for folder (FIG. 13)
88 Horizontal Stitch/seal/glue line between Sheets 'D' (78) and 'C' (76)
90 Horizontal Stitch/seal/glue line between Sheets 'C' (76) and 'B' (74)
92 Horizontal Stitch/seal/glue line between Sheets 'B' (74) and 'A' (70)
96 Main back sheet of two rows opposing two rows type folder
98 Front sheet for uppermost row of pockets
100 Hole to hang the folder
99A Hole to hang the folder
100 Front sheet for upper row of pockets near horizontal fold
102 Front sheet for lower row of pockets near horizontal fold
104 Front sheet for lowermost row of pockets
106 Representative normal seal/stitch/glue line
108 Representative vertical wider seal/double stitch at a fold region
109 Representative horizontal fold/wider seal/double stitch
110 Representative relief hole at crossing of folds
112 Representative trapezium shaped pill pouch
114 Representative rectangular shaped pill pouch
116 Reference arrow showing direction of pouch insertion
118 Representative seal/stitch/glue region of representative pouch in flat
120 Fold of pouch at bottom region of representative pouch in flat
122 Fold at flap region of representative pouch in flat
124 Flap of representative pouch in flat
124A Tip edge of a flap of a pouch in flat
126 Hang nail
128 Single convoluted/folded sheet forming 'stadium seating' style pockets
130 Single strip sheet convoluted, stitched/sealed to form a row of pockets
132 Bridging region of strip between adjacent clusters of paired pockets
134 Bottom longitudinal stitch/seal between a pair of pockets
136F Front transverse stitch/seal between a pair of pockets
136R Rear transverse stitch/seal between a pair of pockets
138L Left flap/cover for half the number of pockets
138R Right flap/cover for half the number of pockets
140 Single pocket in a pair of pockets
142 Single strip sheet with both long edges folded to form pockets
144 Hem/fold near opening of pockets
146 Representative stitch/seal line to form pockets
148L Left transverse fold line at ¼ longitudinal distance
148R Right transverse fold line at ¾ longitudinal distance
150 Center transverse fold line at ½ longitudinal distance
152B Back portion of unsealed/unstitched/unglued pouch
152F Front portion of unsealed/unstitched/unglued pouch
154L Left flap of unsealed/unstitched/unglued pouch
154R Right flap of unsealed/unstitched/unglued pouch
156 Double-fold-flap of unsealed/unstitched/unglued pouch, typ.
158B Bottom region of unsealed/unstitched/unglued multi region pouch
158M Middle region of unsealed/unstitched/unglued multi region pouch
158T Top region of unsealed/unstitched/unglued multi region pouch
159 Pill space separator flap of multi region pouch, typ.
159X Sealed/stitched/glued portion of region separator flap
160 Continuous sheet strip with two longitudinal folds to form pouches
162A Pouch region, first side of folded continuous sheet strip
162B Pouch region, second side of folded continuous sheet strip
164 Transverse trim line to separate pouches
166 Longitudinal trim line to separate pouches
168 Flap of a pouch
170 Fold line for flap of a pouch
172 stitch/seal/glue line of a pouch
174A Fold to form a pouch on first side of sheet (160 above)
174B Fold to form a pouch on second side of sheet (160 above)

DETAILED DESCRIPTION

Pill-Pouch-Pocket-Packet Folder

General Notes Pertaining to all Embodiments:

The flexible pill-pouch-pocket-packet folder (FIGS. 1, 3-9, 12, 13, 14, 16) contains a plurality of pockets (#s 22, 30,140). A plurality of flaps (#s 28, 52, 60, 62, 72, 72A, 138L, 138R), when needed, are provided to cover the pockets. They prevent the pouches from slipping out of pockets during handling. Folders as shown in FIG. 8, 9, 16, 17 have no flaps covering the pockets. By the folding nature of these folders all pockets not only cover each other by the abutting of their flat sides, but also by the facing of each other end to end, the security of the pouches from slipping out is prevented.

Each pocket may contain more than one pouch. When an individual decides to have her/his medication to be separated, say as am/pm or morning/noon/evening etc., more than one pouch can be used in a single pocket. In such case the pouches may have identifying printing or they may be color coded. As an alternative, open pouch with multiple compartments of FIG. 19 (#s 158T, 158M, 158B, 159, 159X) can also be used.

Popular number of pockets in a folder would be 2, 4, 8, 32, 64 etc. Though all varieties would be suitable for home or travel, the 2 and 4 pocket folders may be conveniently used for short term activities, such as a few hour outings, running, biking, one or two day travel, etc. The 8 and 32 pocket versions may be used at home or for travel, for weekly supply or monthly supply of medication. The pockets may be permanently marked with numbers (dates of a month) 1 to 31 (#24) for folders with 32 pockets, and marked Mon, Tue, etc. (#24A) for 8 pocket folders. Spare pockets may or may not be marked (#34, 34A).

Folders may be made of any tough flexible material such as fabric (cotton or plastic), vinyl, leather, non woven and flash-spun fibrous plastics, reinforced paper etc.

Folder pockets can be sewn, glued, heat sealed, RF (radio-frequency) sealed, sonic welded, stapled, etc. (#s 26, 32, 82, 82A, 84, 88, 90, 92, 106, 108, 109,134, 136F, 136R, 146), depending on the material used and manufacturing process preferred. Pouches may be manufactured similarly (#40)

In all figures showing the pockets, when shown to be 'bulging', it is a case only when they contain pouches with contents. Typically, when the pouches inside the pockets are empty, the pockets are in reality substantially flat.

When a folder is made of very flexible materials such as cotton, the folder's folding regions may be created by making more than one stitch line (that normally demarcate adjacent pockets) and with extra gap between them to represent a folding margin. When a folder is made of plastics, such as vinyl, nonwoven, etc and heat sealing, RF sealing, etc. is employed, the width of the seal may be increased to indicate a folding region.

Though an individual pocket and a pill pouch may be designed to be of any desired matching dimensions, to contain average amounts of medication (say, for seniors), a 2" wide pocket, with 1.5" height (depth) is found to be adequate to accommodate a 1.63" wide pouch, of 1.75" height (depth). Such pouch will accommodate 5 to 8 pills of random sizes and it will stick out of the pocket ~¼" after insertion. The protruding/sticking out portion of a pouch allows for retrieval by pinching fingers.

Pouches (FIG. 2, 10, 11, 18, 19, 20, 21, 22, 23, 24), which may in general need to be somewhat stiffer than folder pockets and yet be flexible (#s 54, 114), can also be made of similar materials as of folders but of stiffer grade. They may be closed pouches, or they can be le left totally open with fold creases established (#s 152B, 152F, 154L, 154R, 156).

Each pouch will have a substantially long flap (#s 36, 124, 156, 168) to cover the opening of the pouch (#44). The preferred method of handling the pouch is to pinch the 3 folded layers of pouch material,—namely, (i) the flap, (ii) the front wall (#152F), (iii) the back wall (#152B), all being near the bottom of the pouch sac (46), and insert the pouch into a pocket with its opening reaching the bottom of the pocket. The arrow (#s 42, 116) shows this direction.

When a pill-pouch-pocket-packet folder needs to be folded and stowed away, secure closures can be provided using buttons/button holes (not shown), hook-and-loop fasteners (#s 66, 68) that come as a pair of halves, etc. When fasteners of the hook-and-loop type are provided, they are preferable to be substantially rectangular in construction. If one half is installed parallel in relation to a folder's fold, its mating half is installed perpendicularly in relation to the same fold. The purpose of this perpendicularity is for an individual to more easily achieve a good mating appearance of the folder's fold and still achieve adequate overlapping mating area for the fastener halves, than to be concerned about the fastener halves to be match-mating at the expense of bad appearance of the folded halves of the folder matching.

If the pouches are completely open, and folded closed at the point of use, the closing flap of the pouch may have an extra folded tab, for additional security (FIGS. 18 and 19, #156).

Preferred Embodiment of a Folder and a Pouch:

Folder, FIGS. 16, 17, refer also to "general notes pertaining to all embodiments" In this embodiment a single rectangular sheet (#142), substantially longer than it is wide is folded lengthwise at both edges to form the pockets' depth. Depending on the material used, hem-folds (#144) may be present. The 32 pockets are divided into four groups by fold lines (#s 148L, 150, 148R). Depending on material used a distinct folding feature, such as a seal line, may or may not be present. Pockets' sides are formed by stitching/sealing (#146). Pouches (#54) are inserted into the opposed pockets according to the arrow direction (#42). The arrows are shown for reference and need not be imprinted on the pouches.

To stow away the folder, first the ¼ folds at (#148L) and (#148R) are made. The flats of the pockets abut facing each other and cover each other. The fold at (150) is made last thus mating 'hook-and-loop' halves (#s 66, 68).

Pouch, FIGS. 23, 24, refer also to "general notes pertaining to all embodiments" In this embodiment a single rectangular sheet (#160), substantially longer than it is wide, or continuous in length, is folded lengthwise at both edges (174A, 174B). Stitching/sealing (#172) forms the pouches. Trimming (#s164, 166) forms the individual pouches (#162A, 162B). Preformed crease lines (170) facilitate folding of the flaps.

1$^{st}$ Alternate embodiment (folder only): stadium seating style folder, FIG. 13. Refer also to "general notes pertaining to all embodiments".

A single sheet (#128) is folded to create the spaces for 32 pockets as well as a full flap cover (#72A). Vertical stitches/seals (82A) separate the space created by folds into individual pockets.

2$^{nd}$ Alternate embodiment (folder only): single sheet, 8 pockets, FIG. 4. refer also to "general notes pertaining to all embodiments".

A single sheet (#50) is folded twice to create the space for 8 pockets as well as a full flap cover (#52). The pockets are imprinted with names of the days of the week. 'Hook and loop' fasteners (#s 66, 68) may be used to fasten the flap to the pocket faces and also to secure the folded halves of the folder.

3$^{rd}$ Alternate embodiment (folder only): 32 pockets, FIG. 8. Refer also to "general notes pertaining to all embodiments".

A backing sheet (#96) has on its surface four strip sheets (#s 98, 100, 102, 104) the spaces between which ultimately form the pockets. The strip sheets and seal/stitch lines (#s 106, 108) are oriented such that two rows of pockets face the other two rows as opposites. The folder has three vertical fold/stitch/seal lines (#108), dividing the pockets into ¼ regions, and further it has a horizontal fold line (#109), making further folding it into ⅛ regions a possibility. The three relief holes (#110) may be required, depending on the stiffness of the backing sheet (96), to make the cross folding possible. The folder in the open form may be hung on a wall or a hook using hole (99).

Two types of pouches are shown for reference, trapezium shaped (#112, and FIG. 10) and rectangular shaped (#114, and FIG. 11)

4$^{th}$ Alternate embodiment (folder only), 8 pockets, FIG. 9 Refer also to "general notes pertaining to all embodiments".

The construction of this folder follows substantially in the footsteps of FIG. 8, but for 8 pockets. Only a single horizontal fold line is shown.

5$^{th}$ Alternate embodiment (folder only), 32 pockets, FIGS. 14, 15 Refer also to "general notes pertaining to all embodiments".

This folder uses a single strip sheet (#130) to form a single row of pockets (#140) each abutting the next one on one flat side in pairs. The strip is progressively folded in a serpentine form to form pairs of pockets. Each pair has a small bridging strip (#132) which successively alternates in position from one vertical side of pocket of 1$^{st}$ pair to the other vertical side of next adjacent pair. Each pair has three stitches/seals; one horizontal (#134) to close the bottom of pockets, two on sides (#s 136R, 136F) to close the sides of pockets. The open sides of pockets are covered with flaps (#s 138L, 138R).

If the bottom horizontal stitches/seals are to be avoided, then substantially permanent flap like covers, similar to (#s 138L, 138R) can be installed at the bottom.

Due to the extra compactness of this folder, it may be convenient to imprint 'date' numbers on the pouches rather than on the pockets.

6$^{th}$ Alternate embodiment (folder only), 32 pocket, FIGS. 1, 5, and 12. Refer also to "general notes pertaining to all embodiments".

This embodiment shows a notebook type folders, with each folder leaf comprising four rows of four pockets. FIG. 1 shows the main notebook fold (#20). FIG. 1 shows individual flaps (#28) covering 4 pockets below, where the four pockets are a part of a single sheet with pocket forming stitch/seal lines (#26). Depending on the stiffness/flexibility of materials used for flaps, pockets and main backing sheet, it may be possible to combine the two horizontally side by side flaps into a single flap to cover 8 pockets. Likewise two side by side pocket forming sheets may be combined into a single sheet to form 8 pockets. This arrangement has not been illustrated.

In FIG. 5 the uppermost flaps (#60) are integral with the main back sheet (#58). The lower three sheets (#31) on each leaf of the folder have their flaps integral with the sheets forming pockets (#62) below them. The bottom most pocket forming sheets (#64) have no flaps. Also 'hook-and-loop' fasteners (#s 66, 68) are used to hold the folder securely closed.

FIG. 12 shows two hanging holes to wall mount a folder in open condition (#s 99, 126A).

7$^{th}$ Alternate embodiment (folder only), 64 pockets, FIG. 3 Refer also to "general notes pertaining to all embodiments".

In this embodiment, the folder is made up of two connected notebook style 32 pocket folders, giving one the freedom of 2 months supply of medication.

8$^{th}$ Alternate embodiment (folder only), 32 pockets, FIGS. 6, and 7 Refer also to "general notes pertaining to all embodiments".

Though this folder is similar to FIG. 13, it is made of 5 individual sheets. (#s 70, 74, 76, 78, 80) are stacked 'stadium seating' style using individual sheets. The flap covering all pockets (#72, shown cut out) is integral with the back most sheet (#70). Horizontal stitching/sealing (#s 84, 88, 90, 92) is first finished successively, on adjacent sheets, followed by vertical stitching/sealing (#82) to form the pockets. The center fold (#86) may or may not be a distinct feature of stitching/sealing, depending on, (i) the type of materials used, (ii) the stiffness of the materials, and (iii) the gap between the two central vertical stitches/seals. It could simply be some extra gap between two central vertical stitches (#82).

Alternative Embodiments of Pouches:

Refer also to "general notes pertaining to all embodiments".

FIG. 10: Figure shows flat pattern for a trapezium shaped pouch with the narrow end forming the open end of the pouch. The advantage is in the easier inserting of the pouch (#112) into the pocket, while its broader end makes a secure grab toward the sides of the pocket.

FIG. 18: shows a non sealed/non stitched/non glued open pouch with all the required creases for folds (#s 154L, 154R, 152F, 152B, and 156). The closing flap (#156) has an extra minor fold, so that during pinch holding and handling the pouch closed, there is extra security.

FIG. 19: shows a non sealed/non stitched/non glued open pouch with all the required creases for folds, with two glued/sealed/stitched tabs (#s 159, 159X) dividing the pill storage space into 3 compartments, (#s 158T, 158M, 158B). One can use this compartmentalization to divide pill dosage into, say, am/noon/pm.

FIGS. 20, 21, 22 show together a two piece pouch. FIG. 22 shows a sealed/stitched/glued looped sheet, that will be placed inside an open folded-looped sheet. After the pills are placed inside the closed loop surrounded by the folded-looped sheet, pinch holding the two piece assembly gives adequate security to the formed pouch.

CONCLUSIONS, RAMIFICATIONS, AND SCOPE

Accordingly the reader will see that the invention presented, the pill-pouch-pocket-packet folder will have many other applications, described as follows:

(i) Fishermen and fisherwomen will find the concept applied to present day tackle Boxes;

(ii) organizing spices, seeds, etc. into convenient packets in folders will make displaying, selling easier;

(iii) anytime a variety of small items, such as coins, need to be stored or carried securely, and require easy retrieval capability, the pill-pouch-pocket-packet folder will come handy.

I claim:

1. A flexible storage product of utility comprising;

a flexible sheet, wherein a plurality of fractional portions of said flexible sheet is formed into a plurality of folds, and wherein a fractional plurality of said folds are sealed in a plurality of locations to create a plurality of open pockets; and a plurality of pouches inserted into each one of a plurality of said open pockets, each one of said pouches comprising a single opening with a substantially long flap to fold over and close said single opening, walls, and an opposed closed end, wherein said long flap having a tip which substantially reaches the closed end of said pouch when said long flap is folded over said opening, whereby when said long flap is folded over to close said opening of said pouch, said pouch and contents of said pouch can be handled securely by pinching simultaneously said tip of said long flap and the walls of said pouch adjacent to said tip, and means to securely hold said flexible sheet folded and closed, whereby by inserting a plurality of small items into a plurality of said pouches, the small items and said pouches can be stored in an orderly manner within the pockets, for future retrieval of the small items.

2. A flexible storage product of utility comprising;

a plurality of flexible sheets stacked in a plurality of locations relative to each other and sealed in a plurality of locations to create a single sealed product from said plurality of flexible sheets, wherein a plurality of fractional portions of a plurality of said flexible sheets are sealed with adjacent sheets in a plurality of locations to create a plurality of open pockets; and a plurality of pouches inserted into each one of a plurality of said open pockets, each one of said pouches comprising a single opening with a substantially long flap to fold over and close said single opening, walls and an opposed closed end, wherein said long flap having a tip which substantially reaches the closed end of said pouch when said long flap is folded over said opening, whereby when said flap is folded over to close said opening of said pouch, said pouch and contents of said pouch can be handled securely by pinching simultaneously said tip of said long flap and the walls of said pouch adjacent to said tip, and means to securely hold said single sealed product folded and closed, whereby by inserting a plurality of small items into a plurality of said pouches, the small items and said pouches can be stored in an orderly manner within the pockets, for future retrieval of the small items.

* * * * *